United States Patent [19]

Rioux

[11] 4,325,323

[45] Apr. 20, 1982

[54] COLLAPSIBLE PAINT TRAY CARRIER AND PAINT SPATTER PROTECTOR

[76] Inventor: Jean P. Rioux, 6870 SW. 18 Ct., Pom Pano Beach, Fla. 33068

[21] Appl. No.: 218,545

[22] Filed: Dec. 22, 1980

[51] Int. Cl.[3] ..... B05C 11/16

[52] U.S. Cl. ..... 118/504; 401/15; 15/248 A; 15/248 R

[58] Field of Search ..... 118/504; 427/282; 401/15; 15/248 R, 248 A; 51/310, 274

[56] References Cited

U.S. PATENT DOCUMENTS

| | | | |
|---|---|---|---|
| 2,465,847 | 3/1949 | Coffey | 280/35 |
| 3,044,096 | 7/1962 | Englehart | 15/257 |
| 3,422,798 | 1/1969 | Pine | 118/504 |
| 3,429,296 | 2/1969 | Legere | 118/504 |
| 3,663,982 | 5/1972 | Hayden | 15/248 A |
| 4,166,638 | 9/1979 | Prado | 280/638 |

FOREIGN PATENT DOCUMENTS

| | | | |
|---|---|---|---|
| 344945 | 3/1931 | United Kingdom | 280/79.1 |

*Primary Examiner*—Shrive P. Beck
*Attorney, Agent, or Firm*—Brown & Martin

[57] ABSTRACT

An apparatus for protecting a baseboard and floor adjacent a wall from drips and spatters that occur when a coating of a substance such as paint is applied to the wall with a brush, roller or other applicator. A pair of horizontally extending rectangular side panels are slidably extensible from opposite ends of a horizontally extending rectangular central frame with at least one set of longitudinal edges of the side panels and frame being aligned. When the side panels are fully extended, the aligned longitudinal edges of the panels and frame are positioned closely adjacent the wall so that the side panels and the planar surface of the frame shield the baseboard and floor from drips and spatters. The frame may be supported on casters to permit the extended device to be readily moved along the floor adjacent the wall as the painting proceeds. Clamp mechanisms may be provided on the planar surface of the central frame for releasably holding a paint roller tray carried by the frame.

7 Claims, 5 Drawing Figures

COLLAPSIBLE PAINT TRAY CARRIER AND PAINT SPATTER PROTECTOR

BACKGROUND OF THE INVENTION

The present invention relates to apparatus for facilitating the painting of interior walls of a building, and more particularly, to a collapsible paint tray carrier which can be moved along the bottom of a wall to protect the baseboard from paint drips or spatters which normally occur during the application process.

When painting interior walls of buildings, it is usually desirable to protect the baseboard and floor from paint that drips or spatters as it is applied with a brush or roller. The same is true where the paint is sprayed on a wall or where wallpaper paste, plaster, or other wall coatings are applied. If paint or other liquid falls onto portions of a baseboard or floor covering, either in drops or a fine mist, it must then be cleaned therefrom. Many baseboards are difficult to clean, for example where they are made of natural wood or rubber. Typically, some form of masking device such as tape is affixed to the baseboard to protect it. However, such masking devices are tedious to apply and remove.

It is also typical to spread tarps made of plastic or cloth over the areas of the floor adjacent the wall that is to be painted. However, the spreading and relocation of such tarps is also tedious. Furthermore, it is cumbersome to walk around on tarps. In addition, paint which spatters or drips onto such tarps invariably finds its way onto the bottom of a person's foot and is subsequently tracked onto unprotected areas of the floor. Frequently, portions of such tarps onto which paint has spattered or dripped become turned under and thus the paint ends up on the floor and must be removed with cleaning agents.

In painting interior walls of buildings, usually a paint receptacle such as a paint can or a roller tray must be positioned on the floor or on a step ladder adjacent to the wall that is to be painted. Thereafter, the receptacle must be physically moved along with the painter as the painting progresses. All too often the paint receptacle falls off the ladder or the painter tips over or steps in the receptacle when it is positioned on the floor.

U.S. Pat. Nos. 3,422,798 and 3,429,296 disclose elongated flat shields which may be leaned against a wall to be painted to shield the baseboard from dripping or spattering paint. U.S. Pat. No. 3,044,096 discloses a portable wax cart with an applicator rest. The cart can be readily moved over the floor by pressing the applicator against the applicator rest so that the container can be continuously moved to convenient positions for dispensing the liquid wax therefrom. U.S. Pat. No. 4,166,638 discloses a load carrying dolly having a pair of wheeled frame sections which are slidable, one over the other, to allow the length of the dolly to be adjusted.

SUMMARY OF THE INVENTION

It is therefore a primary object of the present invention to provide an apparatus for protecting the baseboard and floor adjacent an interior wall of the building from spatters and drips which occur as the wall is being painted.

It is another object of the present invention to provide an apparatus of the aforementioned type which can be readily moved along the wall as the painting proceeds.

Accordingly, the present invention provides a mobile, collapsible paint tray carrier and paint spatter protector. In one embodiment, the device incorporates a rectangular frame having two E-shaped side pieces. Two separate, horizontally extendable side panels are slidable above one another between the E-shaped side pieces of the central frame. When collapsed, the side panels overlie one another and are concealed within the central rectangular frame. The central frame is supported on casters and includes a large rectangular upper surface. Clamping mechanisms are attached to this upper surface for releasably holding the side edges of a paint roller tray.

When the device is to be used, each of the side panels is fully extended from the central rectangular frame. In this configuration, the two side panels and the upper surface of the rectangular frame are arranged more or less in end to end fashion to provide a protective shield of substantial length. The device may then be positioned with the side edges of each of the side panels and the center frame closely adjacent to the section of the wall which is to be painted. A roller tray filled with paint may then be placed on the upper surface of the central frame and locked in position by the manually operated clamping mechanisms. As the section of the wall above the device is painted, the device shields the baseboard and the floor from dripping or spattering paint. In addition, the paint tray is conveniently available for replenishing the roller. The tray is also secured so that it will not tip. Furthermore, the paint tray is located where it will not likely be stepped in. As the painting proceeds, the painter can roll the device laterally in the direction of the next section of the wall which is to be painted. This rolling may be conveniently accomplished by pushing sideways on the secured roller tray when the roller is located therein or by pushing on the device with a hand or foot.

BRIEF DESCRIPTION OF THE DRAWINGS

Throughout the figures like reference numerals refer to like parts unless otherwise indicated.

DESCRIPTION OF THE PREFERRED EMBODIMENTS

Figures 1, 2, 3, 4, 5:
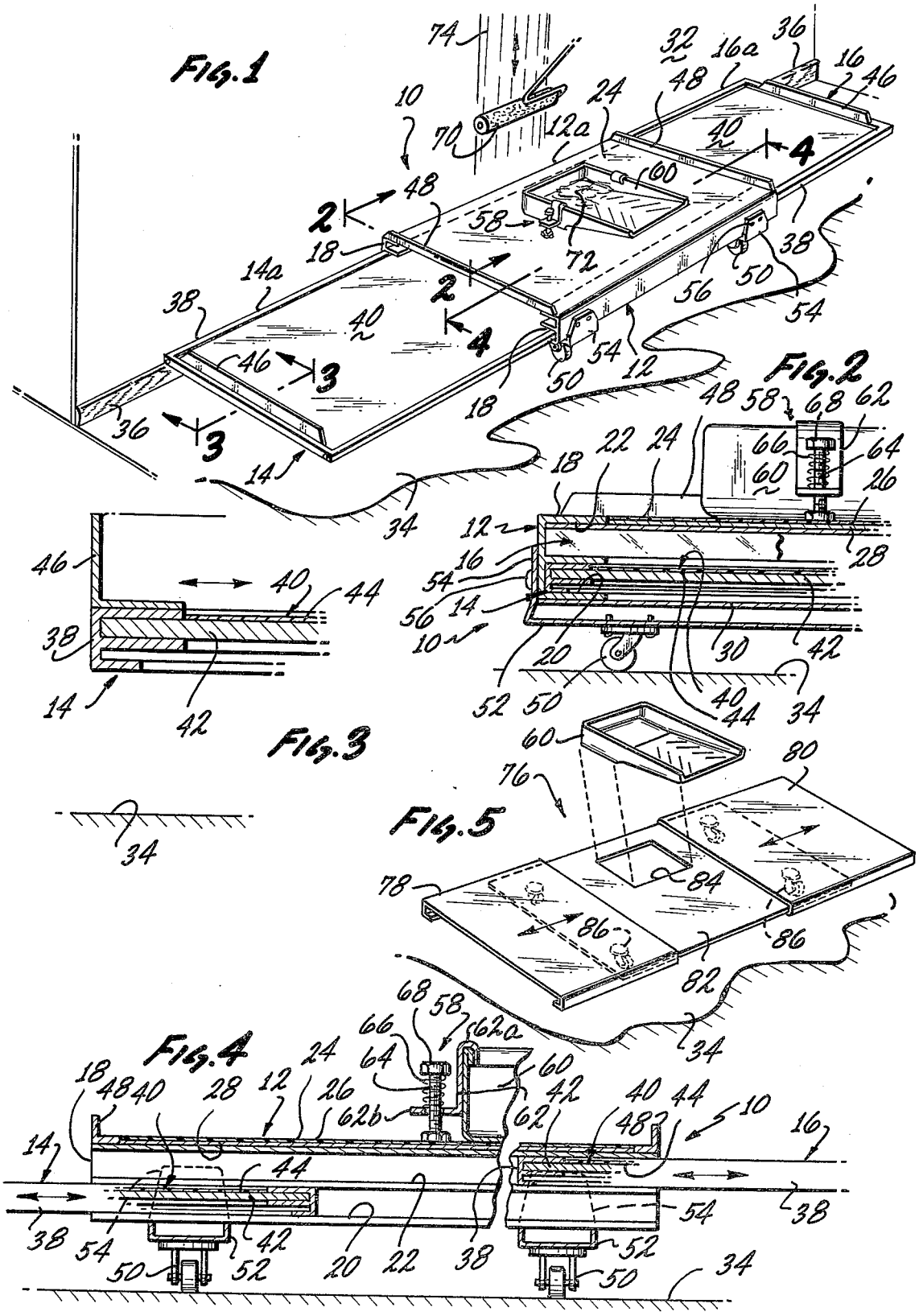
FIG. 1 is a perspective view of a first embodiment of the present invention shown in its expanded configuration adjacent a wall which is being painted.
FIG. 2 is an enlarged, fragmentary vertical sectional view of the first embodiment taken along line 2—2 of FIG. 1.
FIG. 3 is an enlarged, fragmentary vertical sectional view of the first embodiment taken along line 3—3 of FIG. 1.
FIG. 4 is an enlarged, fragmentary vertical sectional view taken along line 4—4 of FIG. 1 illustrating the construction of the central rectangular frame of the device.
FIG. 5 is a perspective view of a second embodiment of the present invention.

Referring to FIG. 1, there is illustrated therein a first embodiment 10 of the present invention which includes a central, horizontal rectangular frame 12 and a pair of horizontal, rectangular side panels 14 and 16. The frame 12 and the panels 14 and 16 are substantially equal in length and width. The panels 14 and 16 are horizontally slidable, one above the other within the central frame 12 as indicated by the arrows in FIG. 4. In their fully extended positions shown in FIG. 1, the side panels 14 and 16 extend from opposite ends of the frame 12 to provide a shield of substantial length and area. When the painting job is completed, the side panels 14 and 16 may be slid inwardly toward one another so that they will be substantially concealed within the central frame 12. In other words, the remote ends of each of the side panels 14 and 16 will be in substantial vertical alignment with corresponding ends of the central frame 12.

The frame 12 includes a pair of E-shaped side pieces 18 (FIG. 2) each defining a pair of upper and lower channels 20 and 22 which receive corresponding side edges of the lower and upper side panels 14 and 16, respectively. The E-shaped side pieces 18 may be constructed of any suitable lightweight, strong material such as extruded aluminum.

The central frame 12 (FIG. 1) includes an upper planar surface 24 which may include upper and lower layers 26 and 28 (FIG. 2) of a suitable sheet material. For example, the upper layer 26 may be made of a lightweight durable material that can be readily cleaned such as plastic or that sold under the trademark FORMICA. The lower layer 28 may be a supporting layer made of a composite wood material such as pressboard or particle board. The longitudinal side edges of the lower layer 24 are secured to the upper legs of the E-shaped side pieces 18.

The central frame 12 may also include a lower planar surface 30 (FIG. 2) which is secured to the lower legs of the E-shaped side pieces 18. The surface 30 may also be made of a suitable lightweight material such as pressboard or particle board. It will thus be understood that the upper and lower planar surfaces 24 and 30 and the side pieces 18 form a rectangular enclosure from which the side panels 14 and 16 may be extended. Preferably, the length and width of each of the side panels is substantially equal to the length and width of the surfaces 24 and 30. When each of the panels 14 and 16 is extended as shown in FIG. 1, each set of longitudinal side edges of the side panels and of the central frame are aligned, i.e., they form a common linear edge. Thus, when the side panels are fully extended, the device can be moved adjacent a wall 32 which is to be painted so that one set of aligned longitudinal edges 12*a*, 14*a* and 16*a* is positioned closely adjacent to the wall. In this position, the side panels and the central frame will shield the portions of the floor 34 and the baseboard 36 adjacent the section of the wall 32 which is to be painted.

Each of the side panels 14 and 16 may have an identical construction and may include an outer rectangular frame 38 (FIG. 1) which encloses and supports a planar surface 40. The planar surface 40 may include a lower supporting layer 42 (FIG. 3) and an upper layer 44 which may be made of suitable materials such as those identified above with respect to the layers 28 and 26 of the central frame. One lightweight, strong construction for the side panels 14 and 16 may be achieved by utilizing an aluminum window frame as the frame 38 with the edges of the supporting layer 42 enclosed by the channels of the window frame as shown in FIG. 3. If desired, the undersides of the frame 38 may be provided with means for reducing the sliding friction between the side panels and the E-shaped side pieces. This may take the form of fuzzy weather stripping, not shown. Each of the side panels 14 and 16 further includes a stop 46 secured along a remote end edge thereof as shown in FIGS. 1 and 3. Preferably, each of the stops 46 extend along a major portion of the transverse length of the end edge of the side panel. These stops engage the ends of the E-shaped side pieces 18 and the central frame to limit further sliding movement of the panels when they are slid inwardly to their fully collapsed positions. In other words, when each of the panels is slid inwardly, their stops will engage the ends of the frame when their planar surfaces 40 are fully concealed within the central frame.

The frame 12 is further provided with a pair of vertically extending walls 48 (FIGS. 1 and 4) which extend along each of its end edges, from the upper surface 24. The stops 46 and the wall 48 may be constructed of aluminum angle bar. The stop 46 of the upper side panel 16 may also engage the wall 48 at one end of the frame to prevent further inward sliding of that side panel. Another advantage of the stops 46 and the walls 48 is that they prevent loose articles which are placed on top of the side panels and on top of the central frame from sliding endwise off the apparatus.

Means are provided for supporting the central frame 12 for sliding movement along the floor adjacent the wall. Such means may take the form of a plurality of skids mounted to the underside of the frame. In the embodiment illustrated in FIGS. 1–4, the supporting means includes a plurality of 360° pivotal casters 50 (FIGS. 1, 2 and 4). A pair of box beams 52 (FIGS. 2 and 4) extend transversely across the underside of the central frame 12 at each end thereof. The ends 54 (FIGS. 1 and 2) of the box beams are bent upwardly and are secured to the outer surfaces of the E-shaped side pieces 18 by screws 56. The casters 50 are bolted to opposite ends of the box beams 52 as best seen in FIGS. 1 and 2. It will be observed that this supporting arrangement positions the central frame and the side panels very close to the floor 34. This feature, together with the fact that the casters are widely spaced, gives the device a very low center of gravity so that it cannot tip over. Furthermore, the low slung configuration of the device is preferred since it permits almost the entire section of the wall 32 to be painted except for a very small portion immediately above the baseboard 36. This small portion is typically painted with a small brush after the major portion of the wall covering is completed. It should also be noted that the device must be supported high enough above the floor so that the aligned side edges 12*a*, 14*a* and 16*a* will be positioned immediately above the upper edge of the baseboard 36 in order to adequately shield the same from spattering and dripping paint.

Preferably, the embodiment illustrated in FIGS. 1–4 is provided with means for firmly holding a receptacle filled with the substance to be applied to the wall on the central frame. The embodiment illustrated in FIGS. 1–4 is provided with releasable clamp mechanisms 58 (FIG. 1) for engaging and holding the edges of a paint roller tray 60. The construction and operation of these clamp mechanisms is shown in greater detail in FIGS. 2 and 4. Each mechanism includes a generally L-shaped clamping member 62 having a reversely curved upper leg portion 62*a* adapted to fit over an upper edge of the tray 60. The member 62 further includes a lower horizontally extending leg portion 62*b*. The shank of a bolt 64 loosely extends through a hole in the leg portion 62*b*. The head of the bolt is rigidly secured to the upper surface 24. A spring 66 (FIGS. 2 and 4) is compressed between the leg portion 62*b* and a nut 68 threadedly engaged with the upper end of the shank of the bolt 64. The clamping members 62 are thus resiliently biased downwardly against the opposing side edges of the paint roller tray 60 to firmly hold the same in position.

The paint roller tray is thus conveniently positioned so that a paint roller 70 (FIG. 1) carried by a painter may be immersed into a quantity of paint 72 filling the tray 60. The roller may then be rolled against the wall 32 to apply a swath of paint 74 to the wall. Any dripping or spattering of paint which occurs as the paint is applied to the wall with the roller falls onto the side panels 14 and 16 or the central frame 12 rather than onto the baseboard or the floor. The length and width of the apparatus are sufficient so that even in the worst case the floor and baseboard are shielded from dripping or spattering paint. Furthermore, as the painting proceeds, the entire protective apparatus may be easily slid in a lateral direction by pushing directly with the hand or foot or by pushing laterally on the tray 60 when the roller 70 is immersed therein. When it is time to begin painting the next wall, the 360° pivotal casters facilitate easy relocation of the apparatus to a position adjacent the next wall.

When it is desired to remove the paint roller tray 60 from the device, the clamping members 62 may be pivoted upwardly and away from the tray to release the same. During the painting process, the clamping mechanisms firmly hold the paint tray in position to prevent paint spillages resulting from tiping of the paint roller tray.

The device illustrated in FIGS. 1–4 is preferably also provided with further stop mechanisms (not illustrated) for limiting the degree to which the side panels may be slid or extended outwardly from the central frame 12. Preferably, the side panels can be slid outwardly until only a small end portion of each of the panels is still within the frame as indicated in FIG. 4. By having the side panels slide snuggly within channels as in the embodiment illustrated in FIGS. 1–4, the side panels can be extended a considerable distance while still retaining a sufficient degree of support.

FIG. 5 illustrates a second embodiment 76 of the present invention. It includes a pair of side panels 78 and 80 which are slidable over a central frame 82. The side panels 78 and 80 may be slid from collapsed positions in which their adjacent ends abut each other to extended positions shown in FIG. 5. In their extended positions, only a small end portion of each of the side panels overlies the central frame as indicated by the phantom lines in FIG. 5. A rectangular recess 84 of suitable dimension is formed in the central portion of the frame 82 for receiving and supporting the paint roller tray 60. Preferably, the recess 84 is sized to accommodate the square forwardmost portion 62*a* of the paint tray. The rearward portion 62*b* of the tray is supported by the portion of the frame 82 rearward of the recess 84. A secondary surface (not visible in FIG. 5) may be secured beneath the upper surface of the frame 82 to provide a support surface for the forward portion 62*a* of the tray. The frame 82 is also provided with a plurality of casters 86 (shown in phantom lines in FIG. 5) for permitting the device to be readily moved along the floor.

Having described preferred embodiments of my collapsible paint tray carrier and paint spatter protector, it should be apparent to those skilled in the art that my invention may be modified in both arrangement and detail. Therefore, the protection afforded my invention should be limited only in accordance with the scope of the following claims.

I claim:

1. An apparatus for protecting a baseboard and floor adjacent a wall when applying a coating of a substance to the wall, comprising:

a horizontally extending rectangular central frame including a pair of E-shaped side pieces each defining upper and lower channels;

means for supporting the frame for movement along the floor; and a pair of horizontally extending rectangular side panels having longitudinal edges, a first one of the side panels having its longitudinal edges slidably received in the upper channels of the E-shaped side pieces and a second one of the side panels having its longitudinal edges slidably received in the lower channels of the E-shaped side pieces, the side panels being slidably extensible from collapsed positions in which the side panels overlie each other to positions in which they extend from opposite ends of the central frame with only a small end portion of each side panel within the frame and with at least one set of longitudinal edges of the frame and side panels being aligned so that when they are positioned closely adjacent the wall, the frame and the side panels will shield the baseboard and the floor.

2. An apparatus according to claim 1 and further comprising:

means positioned on the frame for holding a receptacle filled with the substance to be applied to the wall.

3. An apparatus according to claim 2 wherein the holding means comprises a releasable clamp mechanism for engaging and holding a paint roller tray.

4. An apparatus according to claim 2 wherein the holding means includes a recess formed in the frame for receiving a portion of a paint roller tray.

5. An apparatus according to claim 1 wherein the supporting means includes a plurality of casters mounted to the underside of the frame.

6. An apparatus according to claim 1 and further comprising a pair of stops each positioned at a remote end of a corresponding one of the side panels for engaging the frame and limiting further sliding movement of the panels when the panels are slid inwardly to their collapsed positions.

7. An apparatus according to claim 1 wherein the side panels each comprise:

a rectangular window frame; and a thin planar board enclosed by the window frame.

* * * * *